US006830790B1

(12) United States Patent
Misuda et al.

(10) Patent No.: US 6,830,790 B1
(45) Date of Patent: Dec. 14, 2004

(54) RECORDING MEDIUM, MANUFACTURING PROCESS THEREOF AND IMAGE FORMING METHOD USING THE MEDIUM

(75) Inventors: Katsutoshi Misuda, Yokohama (JP); Kenji Onuma, Machida (JP); Nobuyuki Hosoi, Kazo (JP); Kenji Shinjo, Yokohama (JP); Masanobu Asaoka, Yokohama (JP); Ako Takemura, Miyashiro-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 80 days.

(21) Appl. No.: 09/650,905

(22) Filed: Aug. 30, 2000

(30) Foreign Application Priority Data

Sep. 1, 1999 (JP) ..... 11-247473
Jun. 9, 2000 (JP) ..... 2000-174173

(51) Int. Cl.[7] ..... B41M 5/00

(52) U.S. Cl. ..... 428/32.18; 427/146; 427/359; 428/32.33; 428/32.37

(58) Field of Search ..... 428/195, 212, 428/323, 32.33, 32.18, 32.37; 427/146, 359

(56) References Cited

U.S. PATENT DOCUMENTS

| | | | | | |
|---|---|---|---|---|---|
| 4,202,870 | A | | 5/1980 | Weber et al. | 423/630 |
| 4,242,271 | A | | 12/1980 | Weber et al. | 260/448 AD |
| 4,248,852 | A | | 2/1981 | Wakabayashi et al. | 423/626 |
| 4,460,637 | A | | 7/1984 | Miyamoto et al. | 428/212 |
| 4,642,247 | A | * | 2/1987 | Mouri et al. | 427/214 |
| 4,879,166 | A | | 11/1989 | Misuda et al. | 428/212 |
| 5,104,730 | A | | 4/1992 | Misuda et al. | 428/304.4 |
| 5,264,275 | A | | 11/1993 | Misuda et al. | 428/304.4 |
| 5,270,103 | A | * | 12/1993 | Oliver et al. | 428/219 |
| 5,750,200 | A | * | 5/1998 | Ogawa et al. | 427/361 |
| 5,851,654 | A | * | 12/1998 | Yoshino et al. | 428/328 |
| 5,912,071 | A | | 6/1999 | Takeshita et al. | 428/304.4 |
| 6,114,020 | A | * | 9/2000 | Misuda et al. | 428/212 |
| 6,200,670 | B1 | * | 3/2001 | Hosoi et al. | 428/212 |
| 6,270,881 | B1 | * | 8/2001 | Yuasa et al. | 428/211 |
| 6,342,289 | B1 | * | 1/2002 | Eguchi et al. | 428/195 |

FOREIGN PATENT DOCUMENTS

| | | | | |
|---|---|---|---|---|
| EP | 709223 | * | 1/1996 | B41M/5/00 |
| EP | 0 858 907 A1 | | 8/1998 | |
| JP | 52-9074 | | 1/1977 | |
| JP | 55-27830 | | 2/1980 | |
| JP | 55-51583 | | 4/1980 | |
| JP | 56-157 | | 1/1981 | |
| JP | 58-110287 | | 6/1983 | |
| JP | 2-276670 | | 11/1990 | |
| JP | 03-281384 | * | 12/1991 | B32B/27/20 |
| JP | 4-37576 | | 2/1992 | |
| JP | 5-32037 | | 2/1993 | |
| JP | 6-79967 | | 3/1994 | |
| JP | 10-94754 | | 4/1998 | |
| JP | 10-193777 | * | 7/1998 | B05D/5/04 |
| JP | 11-1060 | | 1/1999 | |
| JP | 11-34482 | | 2/1999 | |

* cited by examiner

*Primary Examiner*—B. Hamilton Hess
(74) *Attorney, Agent, or Firm*—Fitzpatrick, Cella, Harper & Scinto

(57) ABSTRACT

A recording medium comprising on a base material an ink-receiving layer containing an alumina hydrate, said ink-receiving layer being formed by applying a coating liquid containing said alumina hydrate to said base material followed by drying to form a layer to be said ink-receiving layer, swelling said layer to be said ink-receiving layer again, and pressing the swollen layer to a heated mirror-finish drum for drying, the glossiness of the surface of the recording medium on the side of the ink-receiving layer as measured at 20° being 20% or more.

16 Claims, 1 Drawing Sheet

RECORDING MEDIUM, MANUFACTURING PROCESS THEREOF AND IMAGE FORMING METHOD USING THE MEDIUM

BACKGROUND OF THE INVENTION

1. Field of the Invention

The present invention relates to a recording medium suitable for forming a print (printed matter) having texture or image quality comparable to that of a silver halide photograph by applying liquid droplets of ink to a recording medium with an ink-jet recording process or the like; and an image forming method using the medium.

2. Related Background Art

In an ink-jet recording process, images or characters are recorded by ejecting minute droplets of a recording liquid such as ink based on various operation principles, then making them adhere to a recording medium such as paper. This process is characterized by quiet operation at high speed, facilitation of multi-color printing, high adaptability of a recording pattern and no need for development. The ink-jet recording process has become popular rapidly, because its application to an output part of an information apparatus such as copying machines, word processors, facsimiles or plotters, as well as to a printer itself, is proceeding. In recent years, digital cameras, digital videos, scanners or the like of high performance have been provided at a low cost. Owing to such circumstance, together with the spread of personal computers, printers employing an ink-jet recording system for outputting an image information obtained by such apparatuses has come to be used preferably. Under such situations, there is a demand for easy output of an image, which is comparable to a sllver-salt photograph or multi-color print using plates, through an ink-jet recording system.

In order to satisfy such demand, improvements in the structure of a printer itself or printing system, such as increase of the recording speed, heightening of resolution and full coloration, have been conducted; in addition, improvements in the structure or properties of a recording medium are under brisk investigation.

As for a recording medium used for ink-jet recording, a variety of forms have been proposed. For example, disclosed in Japanese Patent Application Laid Open No. 52-9074 is a recording medium which comprises, as an ink-receiving layer, a void-containing layer composed mainly of a silica pigment having a large specific surface area, whereby an improvement in the ink absorbing speed is intended; and in Japanese Patent Publication No. 63-22997 disclosed is a recording medium obtained by adjusting the void of a pigment layer constituting an ink-receiving layer. In Japanese Patent Application Laid-Open Nos. 55-51583 and 56-157, described is a recording medium comprising amorphous silica powder, said amorphous silica powder being added in order to heighten ink absorptivity of an ink-receiving layer, thereby providing a print dot having a high print density and free of ink bleeding.

As for a material used for the ink-receiving layer of a recording medium, an alumina hydrate has recently drawn attentions. Disclosed in U.S. Pat. Nos. 4879166 and 5104730, and Japanese Patent Application Laid-Open Nos. 2-276670, 4-37576 and 5-32037 is a recording medium comprising, as an ink-receiving layer, a layer containing an alumina hydrate of a pseudo-boehmite structure, while disclosed in Japanese Patent Application Laid-Open No. 10-94754 is a recording medium comprising an ink-receiving layer having alumina hydrate particles incorporated therein. In Japanese Patent Application Laid-Open No. 6-79967, a recording medium obtained by casting an alumina-hydrate-containing layer is disclosed as a measure for attaining both high ink absorptivity and high glossiness.

In Japanese Patent Application Laid-Open No. 11-1060, disclosed is a recording medium obtained by successively disposing a porous layer containing barium sulfate and then a layer containing an orientation-free alumina hydrate on a base material. This recording medium has an increased ink absorption rate so that generation of beading can be prevented and at the same time, has excellent print quality.

As for a manufacturing process of a recording medium by using a pigment having ink absorptivity as described above, disclosed in Japanese Patent Application Laid-Open No. 6-79967 is a process of applying a pigment-containing layer onto a fibrous base material which has high absorptivity, low smoothness and low denseness by casting, so that ink absorptivity is increased to carry out recording of an image at a high resolution in a short time. An ink-jet recording medium obtained by the above-described process, however, inevitably swells because the printed portion of the base material absorbs ink. As a result, the surface smoothness of the recording medium and the glossiness obtained by casting decrease.

There are attempts to heighten ink absorptivity by using a pigment having a large pore volume to form a structure having a large number of voids for absorbing and retaining ink, or using an ink-absorptive high-molecular material. In many cases, however, cloudiness caused by irregular reflection occurs inside of the ink-receiving layer, so that a desired image density or glossiness is not attained. Thus, the above-described attempts tend to fail in obtaining texture, image density, saturation or glossiness comparable to that of a silver halide photograph. In addition, it is the present situation that in many cases, a layer for ink absorption (ink-receiving layer) must be formed thick for attaining sufficient image density or saturation, which necessarily increases the cost of each of the material and the manufacturing process.

SUMMARY OF THE INVENTION

An object of the present invention is to provide a recording medium which is suitable for use in an image forming process employing a recording process, such as ink-jet recording process, in which recording is carried out by applying a recording liquid to a recording medium and which makes it possible to produce a print (printed matter) having texture or image quality comparable to that of a silver-salt photograph; a manufacturing process thereof; and an image forming method using the recording medium.

The recording medium of the present invention which can attain the above-described object is a recording medium comprising, on a base material an ink-receiving layer containing an alumina hydrate, wherein said ink-receiving layer is formed by applying a coating liquid containing said alumina hydrate to said base material followed by drying to form a layer to be said ink-receiving layer, swelling said layer to be said ink-receiving layer again, and pressing the swollen layer to a heated mirror-finish drum for drying; and glossiness of the surface of the recording medium on the side of the ink-receiving layer as measured at an angle of 20° is 20% or more.

The manufacturing process of a recording medium according to the present invention comprises the steps of applying a coating liquid containing an alumina hydrate to a base material followed by drying to form a layer to be an ink-receiving layer, swelling said layer to be said ink-receiving layer again, and pressing the swollen layer to a heated mirror-finish drum for drying to form said ink-receiving layer so that the 20° glossiness of the surface of said recording medium on the side of said ink-receiving layer is adjusted to 20% or more.

The image forming method according to the present invention comprises applying ink to the ink-receiving layer of the above-described recording medium, thereby forming an image.

The present invention makes it possible to form an image having texture and image quality comparable to those of a silver halide photograph, because a markedly high glossiness as high as 20% or more as measured at an angle of 20° can be imparted to the surface of a recording medium on which an image is to be formed. Moreover, the present invention makes it possible to provide, easily and at a high speed, a print image which has high resolution and good quality, and at the same time has texture and image quality comparable or superior to those of a silver halide photograph, when a digital camera or the like is selected as an input system and an ink-jet recording system is employed as an output system.

DETAILED DESCRIPTION OF THE PREFERRED EMBODIMENTS

Figure 1:
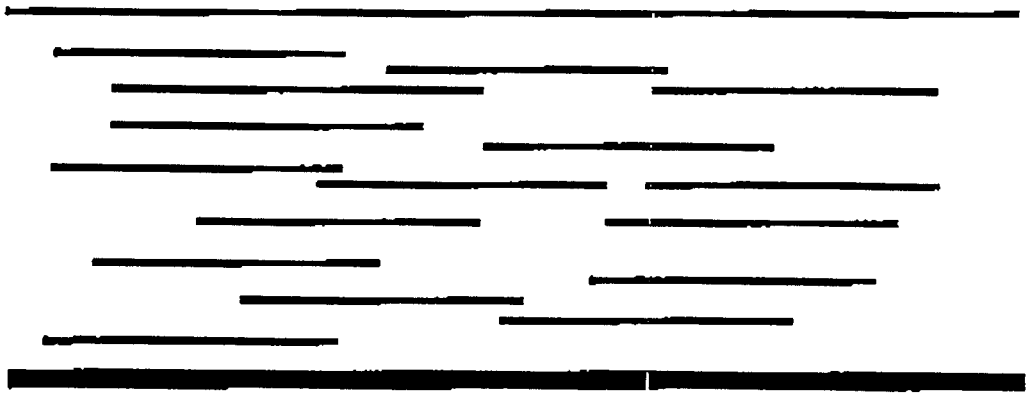
FIG. 1 is a schematic view illustrating orientation of a fibrous alumina hydrate in a coated layer.

The recording medium according to the present invention is composed of a base material and an ink-receiving layer disposed thereon, and an image is recorded on the ink-receiving-layer disposed side of the recording medium. The ink-receiving layer is formed as a porous layer containing an alumina hydrate in which a recording liquid fed from a recording apparatus is absorbed.

As for the base material for the formation of the ink-receiving layer, that having at least a fibrous substrate composed mainly of a wood pulp and a filler can be used, which includes paper subjected to proper sizing and sizing-free paper. To provide the recording medium with high glossiness In the present invention, it is desired to form a surface layer by applying, together with a binder, an inorganic pigment containing at least barium sulfate to the fibrous substrate.

It is desired to use a fibrous substrate having a basis weight of 120 g/m$^2$ or more, more preferably 150 to 180 g/m$^2$ and having a Stökigt sizing degree of 100 seconds or more, more preferably 200 seconds or more in order to impart the recording medium with texture comparable to that of a silver halide photography. By using such fibrous substrate, it is possible to produce a recording medium of even A4 or A3 size without losing excellent appearance.

When a barium-sulfate-containing surface layer is disposed on the fibrous substrate in the present invention, the surface layer may be formed mainly from barium sulfate and a binder. Barium sulfate with impurities removed therefrom as much as possible is preferred, because such barium sulfate improves brightness and light fastness of the surface of the resulting recording medium. In addition, barium sulfate having an average particle size effective for improving smoothness of the surface, glossiness and solvent absorptivity is desired. The average particle size of barium sulfate preferably ranges from 0.4 to 1.0 $\mu$m, and more preferably ranges from 0.4 to 0.8 $\mu$m. By setting the average particle size within the above-described range, a recording medium imparted with better brightness, glossiness and solvent absorptivity can be obtained. If necessary, smoothening treatment such as super calendering may be conducted.

The recording medium imparted with such properties can be obtained because the barium-sulfate-containing surface layer has a markedly high reflectance owing to its high brightness and reflective index. Moreover, the base material is able to have improved surface smoothness by incorporating barium sulfate in its surface layer. The incorporation of barium sulfate is effective against minute waviness on the surface of the base material. It can suppress minute waviness effectively, making it possible to impart the surface with greater glossiness. Any material capable of satisfying the above-described conditions can be used instead of barium sulfate.

In addition, by using a base material obtained by forming a barium-sulfate-containing surface layer on such dense fibrous substrate, it is possible to prevent a twist caused by swelling of an ink-absorbed portion of the substrate upon printing, thereby producing an image without impairing the glossiness attained by casting or the like.

There is no particular limitation imposed on the binder for binding barium sulfate insofar as it is a polymeric molecule having a binding capability. Examples of such binder include synthetic polymeric molecules such as polyvinyl alcohol, vinyl acetate, oxidized starch, etherified starch, casein, gelatin, soybean protein, styrene-butadiene latex, polyvinyl acetate, polyacrylate esters, polyesters and polyurethanes. These binders may be used either singly or in combination as needed. The weight ratio of barium sulfate to the binder preferably falls within the range of 10:0.7 to 10:10, more preferably within the range of 10:5 to 10:1.

Among the above-exemplified binders, gelatin is particularly preferred, because the refractive index of gelatin is close to that of barium sulfate, which makes it possible to effectively reduce the reflection at the boundary of these two substances, thereby heightening the 20° glossiness of the resulting recording medium. Any gelatins subjected to any treatment such as acid treatment or alkali treatment may be used. When barium sulfate is used in combination with gelatin, in other words, they are used as a so-called baryta layer, it is preferred to add gelatin in an amount of 6 to 12 parts by weight based on 100 parts by weight of barium sulfate. In this case, a crosslinking agent for gelatin such as chromium sulfate, chrome alum, formalin or triazine can be used if necessary. The crosslinking agent is preferably added in an amount of 0.2 to 4 parts by weight based on 100 parts by weight of gelatin. As for the crosslinking agent, chromium alum is preferred for its handling ease.

The barium-sulfate-containing surface layer can be formed by applying, to a surface of a substrate on which the surface layer is to be formed, a coating liquid obtained by adding barium sulfate, together with a binder if necessary, to a suitable solvent such as water and dispersing the former in the latter, followed by drying.

The coating amount of the barium-sulfate-containing surface layer preferably falls within the range of 10 to 40 g/m$^2$ in order to impart the recording medium with sufficient absorptivity of a solvent component of ink and to impart it with necessary smoothness. Although no particular limitation is imposed on the coating or drying method upon formation of the barium-sulfate-containing surface layer itself, it is preferred to conduct surface smoothing treatment such as super calendering as a finishing step.

Elution, from the barium-sulfate-contalning layer, of the component of the layer upon formation of an ink-receiving layer can be prevented by heat treatment, combined use of a thermosetting resin and acetal-introducing treatment, chemical reaction by a hardening agent or the like treatment. The coating liquid for the ink-receiving layer becomes cloudy due to the elution of the component of the barium-sulfate-containing layer therefrom upon formation of an ink-receiving layer on the barium-sulfate-containing layer. This adversely affects the transparency of the ink-receiving layer and drying properties during the formation process, which tends to cause defects such as lowering in the surface properties and cracks. In order to eliminate such defects, the above-described treatment is recommended.

To the coating liquid, an additive such as a dispersant, thickener, pH adjuster, lubricant, fluidity modifier, surfactant, antifoaming agent, waterproof imparting agent, mold releasing agent, fluorescent brightener, ultraviolet absorber and antioxidant may be added within an extent not losing the advantages of the present invention.

When a base material having a barium-sulfate-containing surface layer is employed, brightness, smoothness or the like of the recording medium tends to be defined from this surface layer so that it is preferred to set the brightness and Beck smoothness of the barium-sulfate-containing surface layer to attain a whiteness of 87% or more and a Beck smoothness of 400 seconds or more on the ink-receiving layer side of the finished recording medium. Excessively high smoothness happens to deteriorate the absorption of the solvent component in the recording liquid so that it is preferred to set the Beck smoothness of the surface of the recording medium to 600 seconds or less, more preferably 500 seconds or less.

In addition, the base material having high gas permeability is preferred. When the base material has low gas permeability, fibers of the substrate are not dense so that the base material becomes wet by absorbing ink upon printing and causes waviness, sometimes making it impossible to provide texture equivalent to that of a silver halide photograph.

As for the alumina hydrate used for the formation of an ink-receiving layer to be disposed on the base material, those satisfying the desirable properties of 1) a high ink absorption rate without causing excessive bleeding,
2) a high print density and coloring ability, and
3) excellent weatherabiliy, and being capable of forming an ink-receiving layer having a predetermined glossiness as described above can be employed.

As for such alumina hydrate, those represented by the below-described formula are preferred.

$$Al_2O_{3-n}(OH)_{2n}.mH_2O$$

wherein, n stands for an integer of 1, 2 or 3 and m stands for 0 to 10, preferably 0 to 5, with the proviso that m and n do not stand for 0 at the same time. Since $mH_2O$ tends to represent an eliminative water phase which does not take part in the formation of an $mH_2O$ crystal lattice, m may be an integer or not. When such material is heated, m may reach 0. An alumina hydrate can usually be prepared, for example, by a known process such as hydrolysis of an aluminum alkoxide or hydrolysis of sodium aluminate as described in U.S. Pat. No. 4,242,271 or 4,202,870, or a process as described in Japanese Patent Publication No. 57-44605 wherein an aqueous solution of sodium aluminate or the like is neutralized by the addition of an aqueous solution of aluminum sulfate or aluminum chloride.

Rocek, et al. ("Collect czech Chem Commun", 56, 1253-1262(1991)) reported that the porous structure of an alumina hydrate is influenced by any one of precipitation temperature, pH of the solution, aging time or surfactant added. It is known that among alumina hydrates there are a ciliary-pseudo-boehmite and a non-ciliary one as described in the literature (Rocek J., et al., Applied catalysis, 74, 29-36(1991).

The alumina hydrate usable in the present invention preferably has a plate shape having an average aspect ratio of 1 to 4. The conventionally employed fibrous alumina hydrate tends to show parallel orientation (FIG. 1) relative to the surface of a base material upon coating so that pores formed tend to become comparatively small. Casting for imparting the resulting ink-receiving layer with desired surface glossiness tends to lower absorptivity, though not so much compared with calendering or the like. An alumina hydrate in the plate form, on the other hand, has a slight tendency to undergo orientation in a certain direction via coating (FIG. 2) so that the pore size can be formed without being influenced by a coating method. Even casting therefore has almost no influence on the absorptivity. Here, the aspect ratio of the particle is calculated by dividing the major-axis diameter by the minor-axis diameter.

When in such a structure as illustrated in FIG. 1, addition of water by re-wet casting is not so effective for the rearrangement of crystals so that a large amount of water must be added for casting. Accordingly, a fibrous base material having a low denseness is required as the base material.

Figure 2:
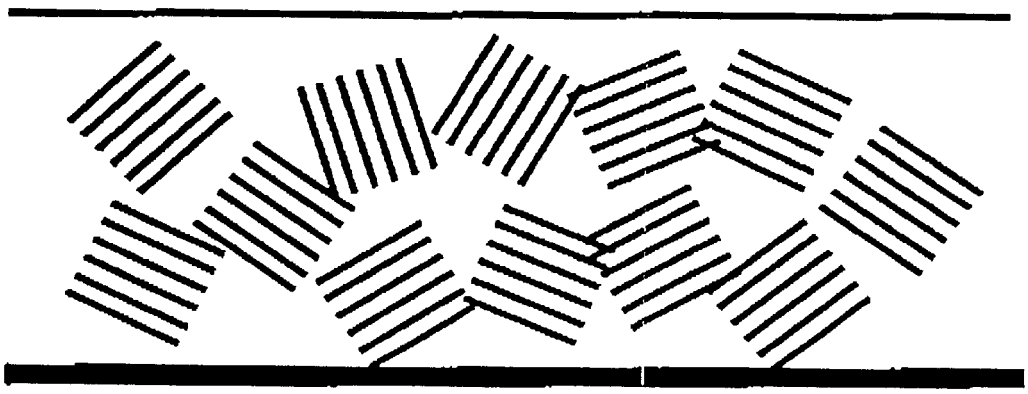
FIG. 2 is a schematic view illustrating orientation of a plate-like alumina hydrate in a coated layer.

In a structure as illustrated in FIG. 2 wherein partially oriented crystals gather at random, on the other hand, even a small amount of water enters into a space of the random structure upon re-wetting and swells the ink-receiving layer, so that rearrangement of crystals tend to occur. In this case, accordingly, it is possible to use a dense base material, and by using it, a glossy medium with less scattered light on the surface of an ink-receiving layer is available.

The alumina hydrate of the present invention preferably has a BET specific surface area ranging from 70 to 300 $m^2/g$, more preferably 100 to 160 $m^2/g$. With the BET specific surface area smaller than the above-described range, the pore size distribution tends to be on larger pores, which happens to prevent sufficient absorption and fixation of a dye in ink. In addition, color density happens to be deteriorated due to irregular reflection in the internal pore. With the BET specific surface area larger than the above-described range, on the other hand, coating of the alumina hydrate with good dispersibility cannot be achieved, thereby sometimes making it impossible to adjust the pore size distribution and to provide sufficient absorptivity.

In addition to the above-described properties such as transparency, glossiness and fixing ability of a coloring agent, such as dye, in a recording liquid, the alumina hydrate which does not produce defects, such as cracks, upon formation of an ink-receiving layer and has good applicability is preferred. From such viewpoints, an alumina hydrate prepared by the above-described known process or selected from the commercially available products such as Disperal HP13 (trade name; product of CONDEA) can be used as a component material of an ink-receiving layer.

For the formation of an ink-receiving layer in the recording medium of the present invention, a binder can be employed as needed. As the binder usable in combination with the alumina hydrate, a water-soluble polymeric molecule can be used. Specific examples include polyvinyl alcohol or modified polyvinyl alcohol; starches or modified starches; gelatin or modified gelatin; gum arabic; cellulose derivatives such as carboxymethyl cellulose, hydroxyethyl cellulose and hydroxypropylmethyl cellulose; conjugated-diene copolymer latex such as SBR latex, NBR latex and methyl methacrylate-butadiene copolymer; functional-group-modified polymer latex; vinyl copolymer latex such as ethylene-vinyl acetate copolymer; polyvinyl pyrrolidone; maleic anhydride or copolymer thereof; and acrylate copolymers. These binders may be used either singly or in combination.

The mixing ratio of the alumina hydrate to the binder can be preferably selected freely from the range of 1:1 to 25:1, more preferably from the range of 5:1 to 10:1, each in weight ratio. By setting the amount of the binder within the above-described range, mechanical strength of the ink-receiving layer can be heightened further, cracks and particle-falling can be prevented upon formation of the ink-receiving layer, and the pore volume can be maintained suitable.

To the coating liquid for the formation of the ink-receiving layer, it is possible to add, in addition to the alumina hydrate and binder, an additive such as a dispersant, thickener, pH adjuster, lubricant, fluidity modifier, surfactant, antifoaming agent, water-proof imparting agent, mold releasing agent, fluorescent brightener, ultraviolet absorber and antioxidant within an extent not losing the advantages of the present invention.

In the recording medium of the present invention having an ink-receiving layer, the ink receiving layer can be formed on the base material by applying a dispersed solution containing the above-described alumina hydrate to the base material by a coating apparatus, followed by drying. No particular limitation is imposed on the coating method, but ordinarily employed one can be adopted which uses a blade coater, air knife coater, roll coater, curtain coater, bar coater, gravure coater, die coater or spraying apparatus. A coating amount of the coating liquid upon formation of an alumina-hydrate-containing ink receiving layer is preferably 30 $g/m^2$ or less, more preferably 20 to 30 $g/m^2$ in terms of a dry solid content, because the fixing property of the coloring component in a recording liquid such as dye and smoothness of the ink-receiving layer need to be improved. Calcination may be conducted as needed after formation of the ink-receiving layer.

Glossiness-imparting treatment to the surface side of the ink-receiving layer of the present invention is preferably conducted by re-wet casting method. In accordance with this re-wet casting method, a layer to be the ink-receiving layer formed by coating followed by drying is made wet and swell again (swelling step) with hot water or the like, and then the wet surface of the resulting layer is dried by pressing it to a heated, mirror-finish drum, whereby the ink-receiving layer is formed. As a result, the ink-receiving layer has strong glossiness on its surface. The reason why this method is preferred is because when the base material is dense, evaporation of the water from the reverse side (on the side of the drum) is markedly limited upon pressing of the ink-receiving layer to a mirror-finish drum to dry it, but wetting of the ink-receiving layer requires only a small amount of water in the re-wet casting method.

For the present invention, the glossiness on the surface side of the ink-receiving layer is measured at 20° which is an angle close to that when people see a recording medium. The conventional recording medium exhibits sufficient glossiness as measured at an angle of 60°, but this standard is accompanied with the problems to be dissolved in the texture or image quality comparable to those of a silver halide photograph. This is because the conventional recording medium does not have sufficient glossiness at an angle from which people see a recording medium. The surface on the ink-receiving layer side of the recording medium of the present invention has glossiness of 20t or more as measured at 20° in accordance with JIS-Z8741, and in addition, almost no difference in glossiness is observed between the printed part and not printed part. Since the ink-receiving layer is mainly composed of alumina hydrate, fixation of a dye is improved due to the positive charge of the alumina hydrate, and therefore the recording medium of the present invention has excellent color reproducibility and sufficient ink absorptivity. As a result, the recording medium of the present invention can produce an image with sufficient texture and image quality comparable to those of a silver-salt photograph. Moreover, owing to the glossiness on the surface side of the ink-receiving layer, the image thus formed has texture and image quality comparable to those of a silver-salt photography, even observed at any angle. Particularly, a glossy medium with less scattered light on the surface of the ink-receiving layer is available by using a base material obtained by forming a barium-sulfate-containing layer on a dense fibrous substrate having a sizing degree of 100 seconds or more.

Since the ink-receiving layer of the recording medium of the present invention is porous in spite of having high glossiness as described above, blocking does not occur easily even if plural recording media are held to be stacked each other with the ink-receiving layer inside; and in addition, fingerprints do not remain easily on the image-formed layer even in the case of direct contact to the image by fingers. Thus, the recording medium of the present invention is improved in handling ability and storage properties.

The recording medium of the present invention further comprises a layer (back coat layer) on the reverse side (the side opposite to the ink-receiving-layer-disposed side) of the base material for preventing the generation of curling upon recording. This back coat layer serves to prevent occurrence of curling due to a difference in elongation or shrinkage between the base material and ink receiving layer depending on humidity, and preferably undergoes a similar change (shrinkage) to the ink-receiving layer on the surface side of the base material upon humidity absorption. This back coat layer can be formed, for example, from an alumina-containing layer. Examples of the alumina include, but not limited to, boehmite, pseudo-boehmite, γ-alumina, and θ-alumina.

Upon formation of a back coat layer, a binder can be used as needed. As a binder usable in combination with an alumina, a water-soluble polymeric molecule can be used. Specific examples include polyvinyl alcohol or modified polyvinyl alcohol; starches or modified starches; gelatin or modified gelatin; caseins or modified caseins; gum arabic; cellulose derivatives such as carboxymethyl cellulose, hydroxyethyl cellulose and hydroxypropylmethyl cellulose; conjugated-diene copolymer latex such as SBR latex, NBR latex and methyl methacrylate-butadiene copolymer; functional-group-modified polymer latex; vinyl copolymer latex such as ethylene-vinly acetate copolymer; polyvinyl pyrrolidone; maleic anhydride or copolymer thereof; and acrylate copolymers. These binders may be used either singly or in combination.

The alumina and binder are preferably mixed at a weight ratio selected freely from the range of from 1:1 to 25:1, more preferably the range of from 5:1 to 10:1. The amounts of the binder within the above-described range brings about a more improvement in curling preventive properties and in mechanical strength of the back coat layer. It is possible to add, to the back coat layer, an additive such as a dispersing agent, thickener, pH adjuster, lubricant, fluidity modifier, surfactant, antifoaming agent, water-proof imparting agent, mold releasing agent, fluorescent brightener, ultraviolet absorber or antioxidant within an extent not impairing the advantages of the present invention.

For the recording medium of the present invention having a back coat layer, the back coat layer is formed on the base material by applying a dispersed solution containing the above-described alumina to the base material by a coating apparatus and then drying. No particular limitation is imposed on the applying method, but an ordinarily employed one which uses a blade coater, air knife coater, roll coater, curtain coater, bar coater, gravure coater, die coater or spraying apparatus can be used. A coating amount of the coating liquid upon formation of an alumina-containing back coat layer is preferably 5 to 25 g/m$^2$ or less, more preferably 10 to 20 g/M$^2$ in terms of a dry solid content. Calcination can be conducted as needed after formation of the back coat layer. By forming such back coat layer, a possibility of generation of curling upon recording can be avoided. Moreover, writing properties with writing utensils such as a pencil, fountain pen, ball point pen or felt pen on the reverse side of the recording medium is improved by the disposal of an alumina back coat layer.

For the formation of an image on the recording medium of the present invention, conventionally known water inks can be used. For the present invention, an ink containing an anionic compound such as anionic-group-containing water-soluble dye is preferably used. Examples of the water-soluble dye usable here include those having an anionic group such as sulfonic group or carboxylic group, such as water-soluble direct dyes, acid dyes and reactive dyes. Such water-soluble dye is incorporated in the conventional ink usually in an amount of about 0.1 to 20 wt. %, which also applies to the present invention. For the present invention, a solvent such as water or a mixed solvent of water with a water-soluble organic solvent is preferred as a solvent for water ink; a solvent of water with a water soluble solvent which contains as the water-soluble organic solvent, a polyhydric alcohol having ink-drying-preventive effects is particularly preferred.

No particular limitation is imposed on the ink-jet recording system employed for the formation of an image by ink-jet recording; examples include an piezoelectric-element employing system and a heater-element employing system.

EXAMPLES

The present invention will hereinafter be described by Preparation Examples and Examples.

Preparation Example 1

Disperal HP13 (trade name; product of CONDEA) was mixed as Alumina hydrate A in pure water, whereby a dispersion having a solid content of 5 wt. % was obtained. Hydrochloric acid was then added to the resulting dispersion to adjust its pH to 4, followed by stirring for a while. Under stirring, the dispersion was heated to 95° C. and It was maintained at that temperature for 2 hours. Caustic soda was then added to the dispersion to adjust its pH to 10 and stirring was continued for 8 hours. Eight hours later, the temperature of the dispersion was decreased to the room temperature and its pH was adjusted to 7 to 8. Then, the dispersion was desalted, followed by deglueing by the addition of acetic acid, whereby a colloidal sol was obtained. As a result of X-ray diffraction of Alumina hydrate B obtained by drying the resulting colloidal sol, it has been found that Alumina hydrate B had a pseudo-boehmite structure. At that time, the BET surface area was 138 m$^2$/g.

Polyvinyl alcohol PVA 117 (trade name; product of Kuraray) was dissolved in pure water, whereby a 9 wt. % solution was obtained. The colloidal sol of Alumina hydrate B was concentrated to yield its 17 wt. % solution. The colloidal sol of Alumina hydrate B and the polyvinyl alcohol solution were mixed by stirring so as to adjust the ratio of the solid content of the alumina hydrate to the solid content of the polyvinyl alcohol to 10:1 in weight ratio, whereby the corresponding dispersion was obtained.

The resulting dispersion was applied to the baryta layer (barium-sulfate-containing layer) of the base material (Beck smoothness of 420 sec and brightness of 89%) to give a dry thickness of 30 g/m$^2$ by die coating, whereby a recording medium 1 having an ink-receiving layer on the baryta-containing-layer was formed. As the above-described base material, employed was that obtained by applying a baryta composition composed of 100 parts by weight of barium sulfate and 10 parts of gelatin to a fibrous substrate having a base weight of 150 g/m$^2$ and a stökigt sizing degree of 200 seconds, followed by calendering treatment.

Example 1

A recording medium 2 was obtained by subjecting the surface of the ink-receiving layer of the recording medium 1 obtained in Preparation Example 1 to re-wet casting treatment with hot water (80° C.) by using a re-wet cast coater.

Preparation Example 2

Sodium aluminate was added to a 4 wt. % aluminum chloride solution to adjust its pH to 4. While stirring, the resulting mixture was heated to 90° C. and the stirring was continued for a while. Then, sodium aluminate was added again to adjust its pH to 10. While maintaining the temperature, aging reaction was conducted for 40 hours. Then, the temperature of the resulting dispersion was decreased to the room temperature and its pH was adjusted to 7 to 8. Then, the dispersion was subjected to desalting, followed by deglueing by the addition of acetic acid, whereby a colloidal sol was obtained. The resulting colloidal sol was dried to obtain-Alumina Hydrate C. As a result of X-ray diffraction, it has been found that Alumina Hydrate C had a pseudo-boehmite structure. At that time, the BET surface area was 158 m$^2$/g. Alumina hydrate C was treated in a similar manner to Preparation Example 1, whereby a recording medium 3 was obtained.

Example 2

A recording medium 4 was obtained by subjecting the recording medium 3 obtained in Preparation Example 2 to re-wet casting treatment in a similar manner to Example 1.

The 20° glossiness with respect to the ink-receiving layer side of each of the recording media obtained in the above Preparation Examples and Examples was measured using a digital varied-angle glossmeter (Suga Tester Co., Ltd.) in accordance with JIS-Z8741. The results are shown in Table 1. On the gloss surface of the ink-receiving layer of each of these recording media, an image according to the photographic information was printed using an inkjet printer (trade name: "BJF-8500", manufactured by CANON Inc.), resulting in the formation of an image having texture or image quality comparable to a silver halide photograph.

TABLE 1

| | Recording medium | 20° glossiness |
|---|---|---|
| Preparation Example 1 | 1 | 8% |
| Example 1 | 2 | 26% |
| Preparation Example 2 | 3 | 10% |
| Example 2 | 4 | 28% |

Example 3

Polyvinyl alcohol "PVA117" (trade name, product of Kuraray) and γ-alumina (average particle size of 1.5 μm) were mixed to have a weight ratio of 100:15 in terms of a solid content, whereby a water dispersion having a solid concentration of 12 wt. % was obtained. The resulting water dispersion was applied to the reverse side (the surface opposite to the ink-receiving layer) of the recording medium 2 obtained in Example 1 at a dry coating amount of 18 g/m$^2$, followed by drying, whereby a recording medium 5 having a back coat layer was obtained.

Even when the recording medium 5 was allowed to stand at 35° C. and a humidity of 90%, it was almost free from curling and was stable. In addition, it was possible to carry out printing on the surface of the back coat layer containing γ-alunina.

Example 4

The recording medium 5 prepared in Example 3 was cut into a post card size of 100 mm×148 mm, whereby a post card paper was obtained. An image according to photographic information or the like was printed on the gloss surface of the post card paper on which an ink-receiving layer had been disposed, while an address was printed on the surface of the back coat layer on the reverse side of the post card paper, each by an ink-jet printer ("BJF-8500", trade name; manufactured by CANON Inc.). As a result, an image having texture and image quality comparable to a silver halide photograph was formed on the gloss surface, while a clear address print without bleeding was obtained on its reverse side, suggesting that it was suitable for use as a post card paper.

What is claimed is:

1. A recording medium comprising, on a base material, an ink-receiving layer containing an alumina hydrate with a BET specific surface area ranging from 100 to 160 m$^2$/g, said ink-receiving layer being the outermost surface layer of the recording medium and being formed by applying a coating liquid containing said alumina hydrate to said base material followed by drying to form a layer to be said ink-receiving layer, swelling said layer to be said ink-receiving layer again, and pressing the swollen layer to a heated mirror-finish drum for drying, the glossiness of the surface of said recording medium on the side of said ink-receiving layer as measured at 20° being 20% or more, wherein said base material comprises a fibrous substrate having a surface layer thereon, and wherein said fibrous substrate has a Stökigt sizing degree of 100 seconds or more.

2. The recording medium according to claim 1, wherein said fibrous substrate has a basis weight of 150 to 180 g/m$^2$.

3. The recording medium according to claim 1, wherein said fibrous substrate has a Stökigt sizing degree of 200 seconds or more.

4. The recording medium according to claim 1, wherein said alumina hydrate has an aspect ratio of 1 to 4.

5. The recording medium according to claim 1, further comprising an alumina-containing layer on the back surface of said recording medium opposite to the surface on which said ink-receiving-layer has been disposed.

6. The recording medium according to claim 5, wherein said alumina hydrate has an aspect ratio of 1 to 4.

7. An image forming method, comprising applying ink to the ink-receiving layer of the recording medium as claimed in claim 1, thereby forming an image.

8. The image forming method according to claim 7, wherein said ink is applied by an ink-jet recording system.

9. A manufacturing process of a recording medium, comprising the steps of applying a coating liquid containing an alumina hydrate with a BET specific surface area ranging from 100 to 160 m$^2$/g to a base material followed by drying to form a layer to be an ink receiving layer, the ink-receiving layer comprising the outmost surface layer of the recording medium, swelling said layer to be said ink-receiving layer again, and pressing the swollen layer to a heated mirror-finish drum for drying to form said ink-receiving layer so that the 20° glossiness of the surface of said recording medium on the side of said ink-receiving layer is adjusted to 20% or more, wherein said base material comprises a fibrous substrate having a surface layer thereon, and wherein said fibrous substrate has a Stökigt sizing degree of 100 seconds or more.

10. A recording medium comprising, on a base material, an ink-receiving layer containing an alumina hydrate with a BET specific surface area ranging from 100 to 160 m$^2$/g, said ink-receiving layer being the outermost surface layer of the recording medium and being formed by applying a coating liquid containing said alumina hydrate to a surface of said base material followed by subjecting said surface of said base material to a re-wet casting treatment, the glossiness of the surface of the recording medium on the side of said ink-receiving layer as measured at 20° being 20% or more, wherein said material comprises a fibrous substrate having a surface layer thereon, and wherein said fibrous substrate has a Stökigt sizing degree of 100 seconds or more.

11. The recording medium according to claim 10, wherein said fibrous substrate has a basis weight of 150 to 180 g/m$^2$.

12. The recording medium according to claim 10, wherein said fibrous substrate has a Stökigt sizing degree of 200 seconds or more.

13. The recording medium according to claim 10, wherein said alumina hydrate has an aspect ratio of 1 to 4.

14. The recording medium according to claim 10, further comprising an alumina-containing layer on the back surface of the recording medium opposite to the surface on which said ink-receiving-layer has been disposed.

15. The recording medium according to claim 14, wherein said alumina hydrate has an aspect ratio of 1 to 4.

16. A manufacturing process of a recording medium, comprising the steps of applying a coating liquid containing an alumina hydrate with a BET specific surface area ranging from 100 to 160 m$^2$/g to a surface of a base material followed by subjecting said surface of said base material to a re-wet casting treatment to form an ink-receiving layer so that the 20° glossiness of the surface of the recording medium on the side of said ink-receiving layer is adjusted to 20% or more, wherein said base material comprises a fibrous substrate having a surface layer thereon, wherein said fibrous substrate has a Stökigt sizing degree of 100 seconds or more, and wherein said ink-receiving layer is the outermost surface layer of the recording medium.

* * * * *

UNITED STATES PATENT AND TRADEMARK OFFICE

CERTIFICATE OF CORRECTION

PATENT NO. : 6,830,790 B1
APPLICATION NO. : 09/650905
DATED : December 14, 2004
INVENTOR(S) : Misuda et al.

It is certified that error appears in the above-identified patent and that said Letters Patent is hereby corrected as shown below:

COLUMN 9
Line 21, "20 g/M$^2$" should read --20 g/m$^2$--.
Line 60, "It" should read --it--.

COLUMN 11
Line 26, "γ-alunina." should read --γ-alumina.--.

Signed and Sealed this

Fifth Day of December, 2006

JON W. DUDAS
*Director of the United States Patent and Trademark Office*